US006065606A

United States Patent [19]

Bonner

[11] Patent Number: 6,065,606

[45] Date of Patent: May 23, 2000

[54] ELEVATABLE FRAME FOR TRANSPORTABLE SORTING MACHINES

[75] Inventor: Carl L. Bonner, Middleton, Id.

[73] Assignee: Diamond Z Manufacturing Co., Inc., Caldwell, Id.

[21] Appl. No.: 09/141,844

[22] Filed: Aug. 27, 1998

[51] Int. Cl.[7] ..... B07B 1/49

[52] U.S. Cl. ..... 209/420; 209/284; 209/241; 209/285; 209/325; 209/331; 280/656

[58] Field of Search ..... 209/420, 421, 209/288, 284, 285, 279, 325, 326, 309, 331, 332, 240, 241, 257, 317, 247; 280/418.1, 401, 400, 656; 414/483

[56] References Cited

U.S. PATENT DOCUMENTS

| | | | |
|---|---|---|---|
| 706,197 | 8/1902 | Owen | 209/420 |
| 1,214,674 | 2/1917 | Harris et al. | 209/420 |
| 3,901,398 | 8/1975 | Bunch | 214/506 |
| 4,178,238 | 12/1979 | Harris | 209/284 |
| 4,190,526 | 2/1980 | Bachand | 209/245 |
| 4,303,506 | 12/1981 | Finlay | 209/247 |
| 4,927,528 | 5/1990 | Doppstadt | 209/284 |
| 4,966,686 | 10/1990 | Sherman | 209/284 |
| 4,983,280 | 1/1991 | Eriksson | 209/420 |
| 5,106,490 | 4/1992 | McDonald | 209/240 |
| 5,183,160 | 2/1993 | McClain | 209/420 |
| 5,234,564 | 8/1993 | Smith | 209/241 |
| 5,577,618 | 11/1996 | Rafferty | 209/421 |
| 5,819,950 | 10/1998 | McCloskey | 209/420 |
| 5,904,364 | 5/1999 | Wylezinski et al. | 280/401 |
| 5,921,742 | 7/1999 | Gearhart | 414/480 |

FOREIGN PATENT DOCUMENTS

| | | | |
|---|---|---|---|
| 0116948 | 5/1988 | Japan | 209/421 |
| 2176423 | 12/1986 | United Kingdom | 209/420 |

*Primary Examiner*—Donald P. Walsh
*Assistant Examiner*—David A. Jones
*Attorney, Agent, or Firm*—Frank J. Dykas

[57] ABSTRACT

A transportable sorting machine frame formed of first and second frame sections which are hinged together is provided. The sorting machine is mounted to one frame section and an infeed conveyor is mounted to the other. A pair of elevational jacks located adjacent to the hinge assemblies are used to tilt the frame sections upward from a horizontal transport position to an elevated position wherein the sorting machine is angled up for proper operation.

15 Claims, 5 Drawing Sheets

ELEVATABLE FRAME FOR TRANSPORTABLE SORTING MACHINES

BACKGROUND OF THE INVENTION

1. Technical Field

This invention generally relates to frame assemblies for sorting machines, and more particularly to a transportable, and elevatable, frame assemblies for sorting machines such as trommel and shaker screen assemblies wherein the infeed conveyor is attached to one portion of the frame and the trommel or shaker screen assembly is attached to the other portion of the frame assembly and where the entire frame assembly is positionable to both a horizontal transport position and an elevated operating position.

2. Background

Trommels and shaker screens, as known in the prior art, are sorting or screening machines which are used to separate, by size, aggregate material such as crushed rock, coal or wood chips, and a wide variety of other materials, into different sized groupings. With a trommel, this is accomplished by passing the material to be separated through a rotating cylindrical screen of a particular screen size. With a shaker screen, this is usually accomplished by use of an eccentric drive or an unbalance rotating weight to produce screen shaking.

Simple trommels may have only one screen sieve size and accomplish a single separating operation wherein the aggregate material that is small enough to pass through the screen is collected on to a moving conveyor, usually called the belly conveyor, underneath the rotating screen, and conveyed away to one location, while the material that is too large to pass through the screen eventually works its way down to the discharge end of the screen and is deposited either on another discharge conveyor or simply dumped on the ground.

Two stage trommel screens have two separate sieve sizes for the rotating screen, with the smaller sieve size being located at the infeed end of the rotating screen, and a larger sieve sized screen located nearer the discharge end of the rotating screen. With two-stage trommel screen assemblies, fine materials are first collected at the infeed end of the rotating screen and conveyed off to one location. Larger material that will pass through the larger sieve size located at the discharge end of the rotating screen is collected by a second conveyor, and conveyed to a second location, and the material that will not pass through any of the screen is discharged at the end and either conveyed away or dropped on the ground.

Shaker screen assemblies are similar, in many respects, to trommel assemblies. They may have one, two or even several shaker screens of differing screen sieve sizes, arranged in a descending stacked order, with the largest sieve size screen placed on top of the stack, with progressively smaller sieve size screens stacked underneath, in sequential order, for the material to be separated to pass over. Conveyor assemblies and drive systems, similar to those used with trommel assemblies, are also provided.

In order for a trommel assembly to work, the infeed end of the rotating screen must be elevated so that material that is infed into the infeed end of the rotating trommel screen will, as it is agitated, work its way down parallel to the longitudinal axis of the screen to the discharge end. If the infeed end of the rotating screen was not elevated, the trommel screen would eventually fill with oversized material and cease to function. The same is true for shaker screens.

If one end is not elevated, the material to be separated will not work its way down the screens, and the assembly will cease to function to separate material.

In some applications, trommel and shaker assemblies can be more or less permanently located on site. Examples would include processing areas at coal mines and rock quarries. In these applications there is typically provided an infeed conveyor which is used to elevate the material to the infeed end of the trommel or shaker screen and drop it in. These infeed conveyors can be permanently mounted, and the mined or quarried material is brought to the trommel or shaker assembly for sizing, separating and processing.

In other applications, the trommel or shaker assemblies must be portable. The reason for this is that there may not be enough material located at the site to be sized and separated at any given time to facilitate continuous operation. Since trommel and shaker assemblies are often times large and very expensive pieces of machinery, it is not, cost justifiable to leave, in situ, a trommel or shaker assembly which will only be operated one or two days a week or month. An example of this type of application is a logging operation where tree stumps and slash from the logging operation are collected and ground into wood chips using a rotating tub grinder, such as that described in U.S. Pat. No. 4,997,135. Once a particular area has been logged and the tree stumps and slash collected from the area, there will be no more material to be ground and removed, and any trommel or shaker assembly that has been used to separate the material into various sizes will have to be moved to the next logging location.

In some logging operations, the ground wood chip material to be separated by use of the trommel or shaker assembly is not generated at a rate sufficient to justify the full-time use of the trommel or shaker assembly, and as a result, the trommel or shaker assembly is periodically brought to the site, used for a few days, and then moved on to another site. In these situations, transportable trommels or shakers can be economically justifiable, since the separated material can easily be separated into fine material which is of high economic value and generally used as mulch for gardens and flower beds, and the intermediate size material can be used as a fuel for power generation, or further processed into wood pellets for use in home heating. And finally, the oversized material can be reprocessed through a rotating tub grinder, so that all of the tree stumps and slash from the logging operation can be fully utilized as value added products in one form or another.

The problem in the prior art is the time it takes to transport the trommel or shaker assembly and set them up for use. For example, in use with logging operations to generate separated, sized wood chip material, the trommel or shaker assembly is transported by a convoy of trucks. One truck transports the trommel or shaker, the second transports the infeed conveyor, and a third transports a front end loader or other piece of industrial machinery which is used to load the material to be separated onto the infeed conveyor, and also the separated, sized material into trucks for transport from the site. If the infeed conveyor is a separate piece of machinery, it must be attached in some form to the trommel or shaker assembly, and this process can take several hours, even for a skilled crew. Thus, in the prior art, an operator would need an extra truck to transport the infeed conveyor, and extra time to set up the entire assembly for operation.

A prior art alternative is to eliminate the infeed conveyor altogether, and instead just provide for a permanent, fixed loading chute at the input end of the trommel or shaker screens. The problem with this arrangement is that the infeed end of the trommel or shaker screen must be elevated in order for the trommel or shaker to work effectively. Thus, a prior art infeed chute is generally located twelve to sixteen feet in the air, thus requiring the use of a larger front end loader capable of elevating its dump bucket far into the air. Not only does this increase the machinery requirements by requiring a larger front end loader, but it also reduces the cycle time of the front end loader, since it has to lift the material higher into the air in order to dump it into the infeed end of the trommel or shaker screen.

Accordingly, what is needed is a transportable sorting machine such as a trommel screen assembly or a shaker screen assembly where the infeed conveyor is formed as an integral part of the sorting machine, and where the entire assembly is positionable to a horizontal transport position which is within transportable trailer length restrictions, and where two portions of the frame can be quickly elevated to reposition the trommel or shaker assemblies to an operating position while the receiving end of the in feed conveyor remains at a lowered elevation.

DISCLOSURE OF INVENTION

These objects are achieved by use of a transportable sorting machine formed of a frame assembly having first and second frame sections which are hinged together. A rotatable trommel screen or shaker assembly is mounted to the first frame section. Also attached to the first frame section is an engine unit operable to rotate the trommel assembly or vibrate the shaker screens. Attached to the second frame section are wheel and axle assemblies and an infeed conveyor.

A pair of front stabilizer jacks are provided attached to the tongue end of the first frame section and a pair of elevational jacks are attached to the opposite end adjacent to the hinge assemblies interconnecting the first and second frame sections.

The elevational jacks are used to elevate the infeed end of the trommel screen or shaker screen assembly so that material will flow down through the trommel screen or down over the vibrating screens of the shaker screen assembly with oversized material eventually dropping off of the open back. A belly conveyor assembly is located beneath the trommel screen or shaker screen assembly and is used to convey screen material from underneath the trommel or shaker screens to a discharge conveyor. The front discharge conveyor is repositionable to a raised transport position and a lowered use position. As the first frame section is raised, the second frame section which is hinged to it, is also raised, elevating the infeed conveyor to an appropriate operating position.

The pair of hinge assemblies interconnecting the first and second frame rail sections are formed of pivot pins and a hinge bracket attached to each of the frame rails of the first frame section. The hinge bracket is configured such that the hinged ends of the second frame rail section will rest against the rail bracket in the transport position. A locking pin assembly is also provided for each hinge to lock it in the transport position.

BEST MODE FOR CARRYING OUT INVENTION

In this best mode section of the specification the principles of the present invention are described in the context of a transportable trommel assembly. However it should be understood that the principles of the present invention are directly applicable to any sorting machine, or other machine, where there is used an infeed conveyor of some sort, and a need to elevate, to an angle, a sorting machine or other machine, which requires elevation to an angled orientation for proper operation.

Figure 1:
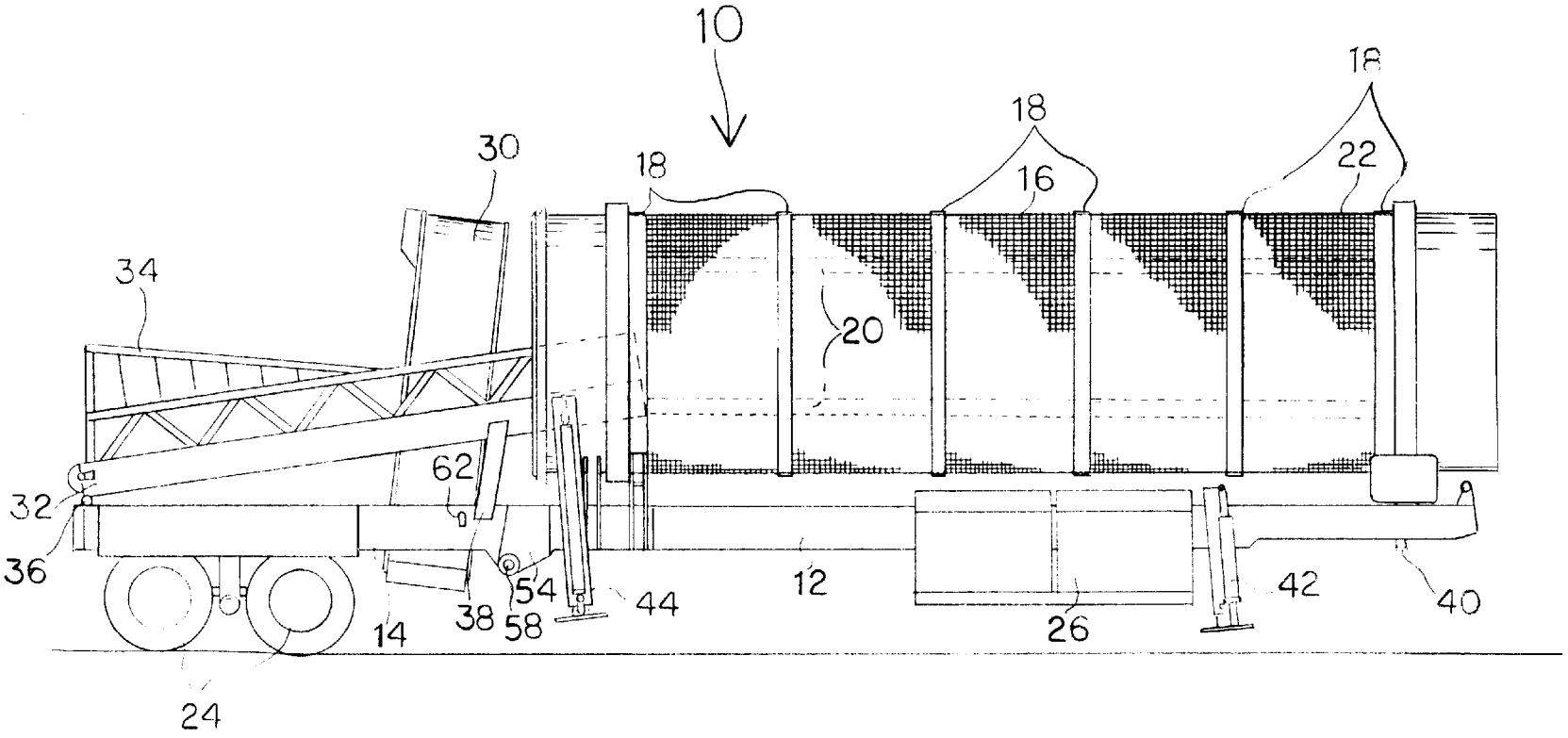
FIG. 1 is a representational side view of the transportable trommel assembly in a transport configuration.
Figure 3:
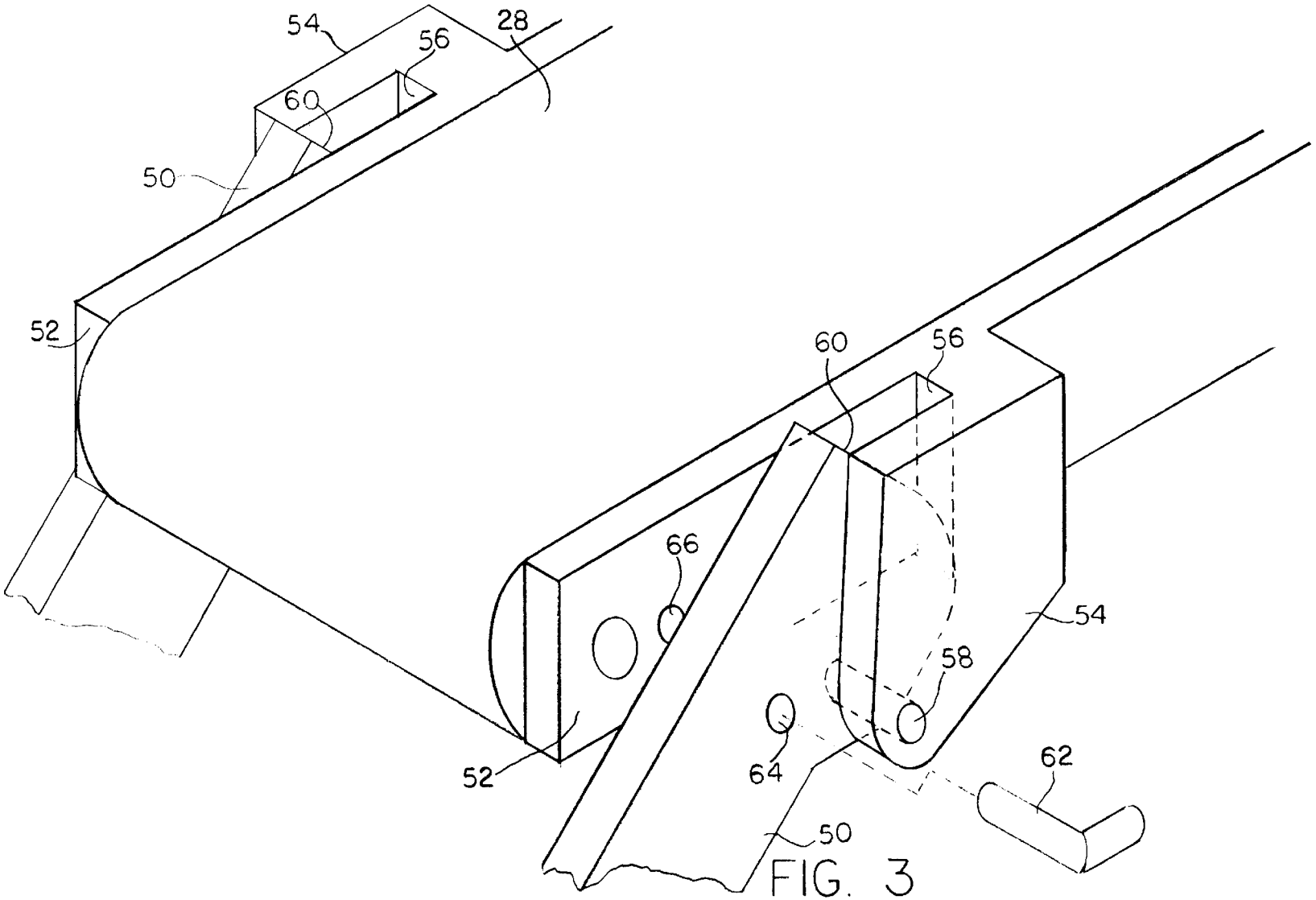
FIG. 3 is a perspective representational view of the hinge assembly in the operating position.

Referring to FIG. 1, there is shown a representational side view of a transportable trommel assembly 10 in the transport position, ready to receive a truck for purposes of being transported. Transportable trommel assembly 10 is formed of a frame assembly formed of first frame section 12 and second frame section 14. Each frame section, in the preferred embodiment, is formed of a pair of juxtaposed frame rails. For first frame section 12, those are frame rails 52, as shown in FIG. 3. They are held in place by means of cross braces, not shown, but well known in the art. For second frame section 14, the frame rails shown in FIG. 3 are identified as frame rails 50. There are a variety of different designs available for the frame sections, including the use of box or channel members, interconnected by means of solid or lattice cross bracing. Rotatable trommel screen assembly 16 is mounted to first frame section 12. Rotating trommel screen assembly 16 is formed of longitudinal rails 20, and a series of spaced frame hoops 18, to which is attached trommel screen 22. Attached to second frame section 14 are wheel and axle assembly 24. Engine unit 26, which is used to rotate trommel screen assembly 16, is attached to first frame section 12. A pair of stabilizer jacks 42 are provided, attached to the tongue end of first frame section 12, and a pair of elevational jacks 44 are attached to the opposite end in proximity to the hinge assemblies.

Figure 2:
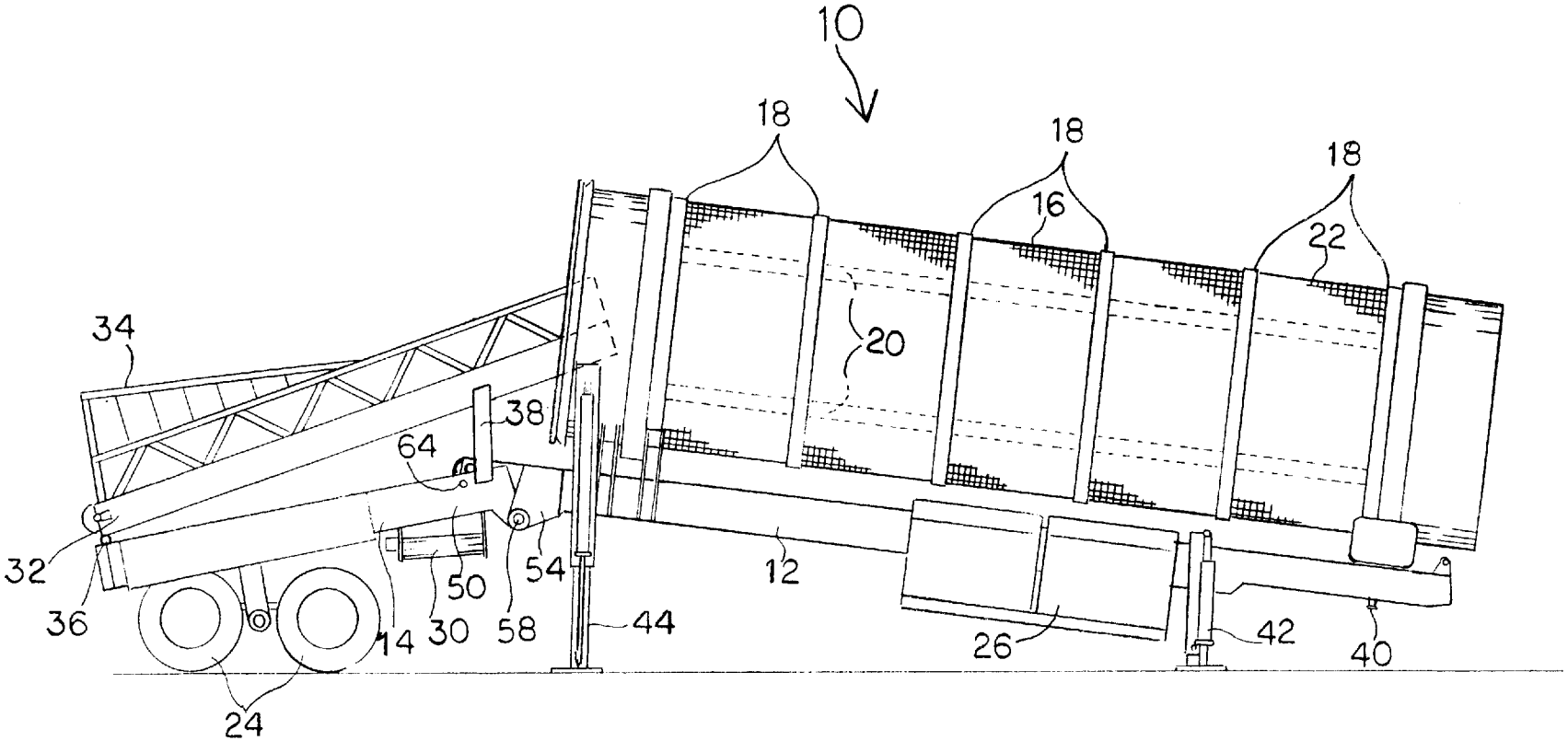
FIG. 2 is a representational side view of the transportable trommel assembly in an operating position.

Not shown in FIGS. 1 and 2, but partially shown in FIG. 3, and well known in the art, is belly conveyor 28 located beneath the trommel screen assembly 16 which is used for conveying screened material from underneath trommel screen 22 to discharge conveyor 30. In FIG. 1, conveyor 30 is shown in the transport position, in which it is folded up.

In FIG. 2, front conveyor 30 is extended out and used to carry away sieved and segregated materials. All of this is well known in the art and plays no part of the present invention.

As can be seen in FIG. 2, elevational jacks 44 are used to elevate the infeed end of trommel screen assembly 16, so that material will flow down through the trommel screen, with oversized material eventually dropping out the open back or discharge end. Stabilizer jacks 42 are used to level and hold the entire assembly in place.

Second frame section 14 supports infeed conveyor 32 and dumping bin 34. Material to be screened is dropped by means of a front end loader or other suitable equipment into dumping bin 34 from where it is conveyed by infeed conveyor 32 up and into trommel screen assembly 16. Infeed conveyor 32 is, in the preferred embodiment held in a fixed angled position by means of pin 36 and fixed elevated strut 38. However, it should be apparent to those skilled in the art that a suitable hydraulic system could be substituted for fixed elevated strut 38 to adjust the position of infeed conveyor 32 relative to trommel screen assembly 16. However, it is found in practice that this is not necessary Second frame section 14 is interconnected to first frame section 12 by means of a pair of hinge pin assemblies, as shown in representational format in FIG. 3. Each hinge is formed of rail bracket 54 attached to first frame section rail 52. Rail bracket 54 has a receiving slot of sufficient width to receive second rail frame section rail 50. First and second frame section rails 50 and 52 are interconnected by means of pivot pin 58.

Rail bracket 54 is configured so that when the trommel screen assembly 10 is in its transport configuration, as shown in FIG. 1, rail frame bearing surface 60 of second frame section rail 50 rests, in compression, against rail bracket bearing surface 56. As a safety precaution, a locking pin system is provided, utilizing locking pin 62 which interfits through first hole 64 in second frame section rail 50 and second hole 66 and first frame section rail 52. The holes are aligned and when the trommel screen assembly is in its transport position, locking pin 62 can then be inserted so as to provide an additional safety factor during transport. Safety pin 62 is offset from pivot pin 58 so as to provide continued support in the event that pivot pin 58 were to break during transport of trommel screen assembly 10. It should be apparent to those skilled in the art that there are a variety of hinging first and second rail sections 12 and 14 together, as well as a number of alternative methods of latching them as a safety precaution during transport.

In the transport position, as shown in FIG. 1, infeed conveyor 32 extends into the central area of trommel screen assembly 16. When the safety pins 62 are removed and the elevation jacks 44 are operated to raise the front end of trommel screen assembly 16 to the desired angle for operation. When this occurs the hinged end of second rail section 14 is also elevated, and second frame section 14 will roll forward a small amount on wheel assembly 24 with infeed conveyor 32 staying in the same relative infeed position relative to trommel screen assembly 16.

To return to the transport position, the operator merely lowers elevation jacks 44 and stabilizing jacks 42 to their transport position allowing first and second frame sections 12 and 14 to return to their transport position with rail frame bearing surfaces 60 in compression against rail bracket bearing surfaces 56. Safety pins 62 are then inserted and the trommel is ready for transport. Set up operation and break down for transport is simple and takes literally just a matter of minutes, as opposed to hours with prior art designs. This represents a considerable savings in time and labor over the prior art.

In the preferred embodiment, elevation jacks 44 are attached to the first frame section adjacent to hinge pins 58. It should be pointed out that it is not essential that elevation jacks 44 be so placed. They could also be attached to second frame section 14 adjacent to hinge pins 58. However, in such case, stabilizing jacks 42 would have to be provided with some sort of wheels, so as to allow a limited amount of horizontal movement of first frame section 12.

Figure 4:
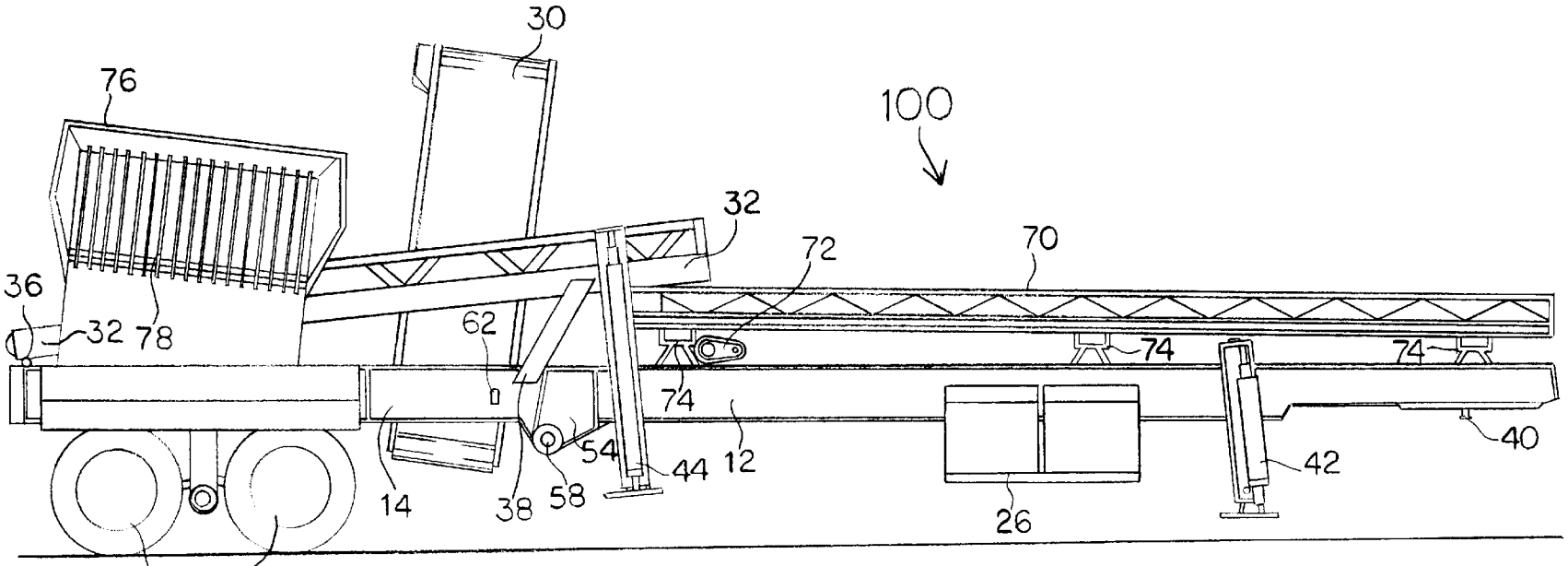
FIG. 4 is a representational side view of the transportable shaker screen assembly in a transport position.
Figure 5:
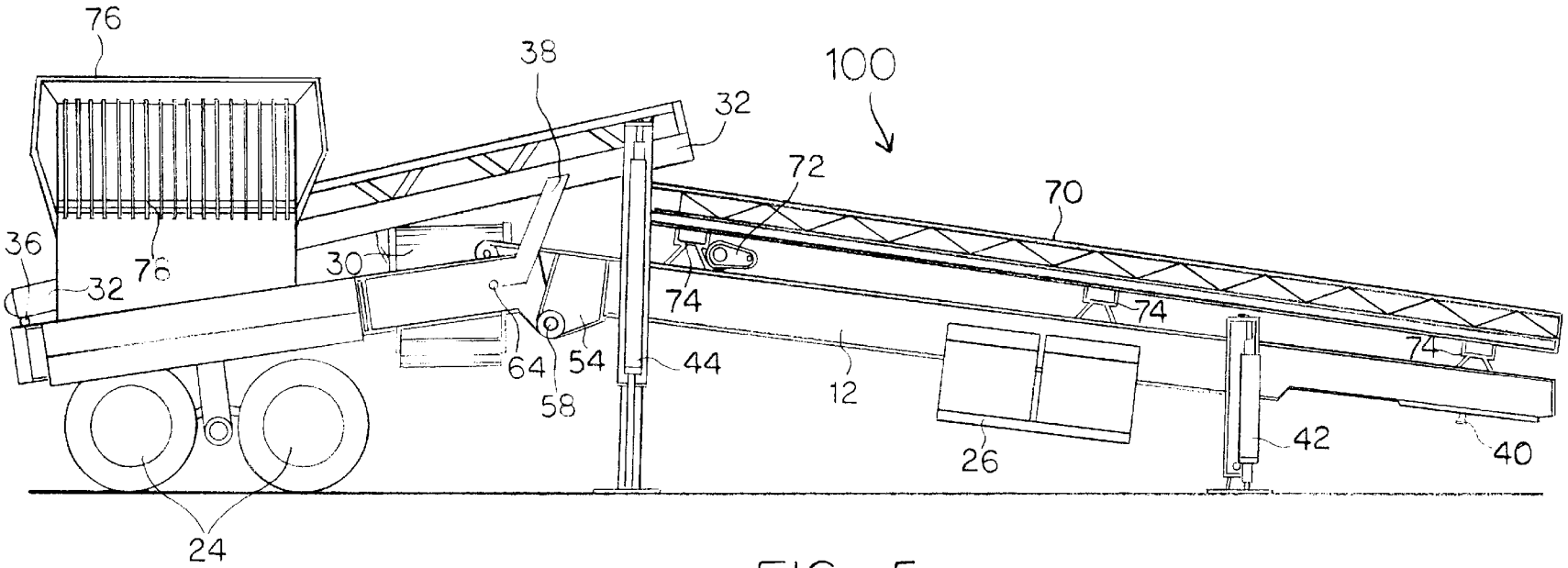
FIG. 5 is a representational side view of the transportable shaker screen assembly in an operating position.

In FIGS. 4 and 5 there is shown in representational format a side view of a transportable shaker screen assembly 100. In FIG. 4 it is in the transport position, and in FIG. 5, it is shown in the operating position. The frame assembly is essentially the same as for transportable trommel assembly 10. First frame section 12 is formed of a pair of juxtaposed frame rails 52, as shown in FIG. 3, and are held in place by cross braces, not shown, but well known in the art. First frame section 12 supports shaker screen assembly 70, supported on shock mounts 74, and shaken by use of eccentric drive motor 72. Power, usually hydraulic, is supplied to all of shaker screen assembly 100 by engine unit 26 which is also mounted to first frame assembly 12. Tongue 40, for connection of shaker screen assembly 100 to the fifth wheel of a truck is also attached to first frame section 12. Elevation jacks 44, and stabilizing jacks 42, as previously described for transportable trommel assembly 10, complete what is attached to first frame section 12.

The hinge assembly which interconnects first frame section 12 to second frame section 14, including rail brackets 54 and hinge pins 58, are also the same as those shown in FIG. 3 and described in the description of transportable trommel assembly 10.

Also, as shown in FIGS. 4 and 5, is infeed conveyor 32 is attached to second frame section 14 by means of attachment pin 36 and a pair of fixed elevating struts 38 in the same manner as has been previously described for tommel assembly 10. Wheel assembly 24 is also provided. The primary difference between the equipment attached to second frame section 14 of transportable shaker screen assembly 100 and transportable trommel screen assembly 10 is that dumping bin 34 is replaced with dumping bin 76, to which is attached and angled grate 78 which is used to separate out material which is too large to ever have a chance to pass through the sieves of shaker screen 70. Discharge conveyor 30 also functions as has been previously described.

While there is shown and described the present preferred embodiment of the invention, it is to be distinctly understood that this invention is not limited thereto but may be variously embodied to practice within the scope of the following claims.

I claim:

1. An elevatable frame for transportable sorting machines for separating material, which comprises:

a frame, said frame having a longitudinal axis and being divided into first and second frame sections which are pivotally interconnected together;

an operable sorting machine, having an infeed end, and a discharge end, operably mounted to said first frame section an operable infeed conveyor attached to said second frame section and configured in size and shape to receive material to be separated and convey it into said infeed end of said sorting machine;

means for elevating one of the frame sections to elevate said infeed end of said sorting machine and to form an angled relationship between said first and second frame sections about said pivot point.

2. The elevatable frame of claim 1 wherein said means for elevating one of the frame sections to form an angled relationship between said first and second frame sections about said pivot point further comprises:

at least a pair of elevating jacks each attached to the same frame section on opposite sides of said longitudinal axis in the same relative longitudinal position, and operable to elevate said pivotal interconnection between said first and second frame sections.

3. The elevatable frame of claim 1 wherein said frame further comprises at least a pair of juxtaposed and interconnected longitudinal frame rails, said frame rails each divided into first and second sections of rail at the same relative longitudinal position along said longitudinal axis, said first and second sections of each rail being pivotally interconnected so as to form first and second frame sections of said frame.

4. The elevatable frame of claim 3 wherein said frame rails of one of said frame sections are laterally offset, overlapping and hinged to the corresponding frame rails of the other frame section.

5. The elevatable frame of claim 4 wherein each of said hinges further comprises:

a rail bracket attached to a frame rail, said rail bracket having a receiving slot and a bearing surface at the end of said slot, said slot being sized and configured to receive and hold in compression against said bearing surface the end of the corresponding frame rail of the other frame section when said frame sections are in an aligned and non-angled relationship; and a hinge pin for rotatably holding said other frame rail section within said slot.

6. A transportable trommel assembly, for separating material, which comprises:

a frame, said frame having a longitudinal axis and being divided into first and second frame sections which are pivotally interconnected together;

a cylindrical trommel screen, having an infeed end, and a discharge end, rotatably mounted to said first frame section;

means from rotating said trommel screen operatively connected to said trommel screen;

an operable infeed conveyor attached to said second frame section and configured in size and shape to receive material to be separated and convey it into said infeed end of said trommel screen;

means for elevating one of the frame sections to elevate said infeed end of said trommel and to form an angled relationship between said first and second frame sections about said pivot point.

7. The transportable trommel assembly of claim 6 wherein said means for elevating one of the frame sections to form an angled relationship between said first and second frame sections about said pivot point further comprises:

a pair of elevating jacks each attached to the same frame section on opposite sides of said longitudinal axis in the same relative longitudinal position, and operable to elevate said pivotal interconnection between said first and second frame sections.

8. The transportable trommel assembly of claim 6 wherein said frame further comprises at least a pair of juxtaposed and interconnected longitudinal frame rails, said frame rails each divided into first and second sections of rail at the same relative longitudinal position along said longitudinal axis, said first and second sections of each rail being pivotally interconnected so as to form first and second frame sections of said frame.

9. The transportable trommel assembly of claim 8 wherein said frame rails of one of said frame sections are laterally offset, overlapping and hinged to the corresponding frame rails of the other said frame section.

10. The transportable trommel assembly of claim 9 wherein each of said hinges further comprises:

a rail bracket attached to a frame rail, said rail bracket having a receiving slot and a bearing surface at the end of said slot, said slot being sized and configured to receive and hold in compression against said bearing surface the end of the corresponding frame rail of the other frame section when said frame sections are in an aligned and non-angled relationship; and a hinge pin for rotatably holding said other frame rail section within said slot.

11. A transportable shaker screen assembly, for separating material, which comprises:

a frame, said frame having a longitudinal axis and being divided into first and second frame sections which are pivotally interconnected together;

a shaker screen, having an infeed end, and a discharge end, operatably mounted to said first frame section;

means from operating said shaker screen operatively connected to said shaker screen;

an operable infeed conveyor attached to said second frame section and configured in size and shape to receive material to be separated and convey it into said infeed end of said shaker screen;

means for elevating one of the frame sections to elevate said infeed end of said shaker screen and to form an angled relationship between said first and second frame sections about said pivot point.

12. The transportable shaker screen assembly of claim 11 wherein said means for elevating one of the frame sections to form an angled relationship between said first and second frame sections about said pivot point further comprises:

a pair of elevating jacks each attached to the same frame section on opposite sides of said longitudinal axis in the same relative longitudinal position, and operable to elevate said pivotal interconnection between said first and second frame sections.

13. The transportable shaker screen assembly of claim 11 wherein said frame further comprises at least a pair of juxtaposed and interconnected longitudinal frame rails, said frame rails each divided into first and second sections of rail at the same relative longitudinal position along said longitudinal axis, said first and second sections of each rail being pivotally interconnected so as to form first and second frame sections of said frame.

14. The transportable shaker screen assembly of claim 13 wherein said frame rails of one of said frame sections are laterally offset, overlapping and hinged to the corresponding frame rails of the other said frame section.

15. The transportable shaker screen assembly of claim 14 wherein each of said hinges further comprises:

a rail bracket attached to a frame rail, said rail bracket having a receiving slot and a bearing surface at the end of said slot, said slot being sized and configured to receive and hold in compression against said bearing surface the end of the corresponding frame rail of the other frame section when said frame sections are in an aligned and non-angled relationship; and a hinge pin for rotatably holding said other frame rail section within said slot.

* * * * *